US005538185A

United States Patent [19]

Rabitsch et al.

[11] Patent Number: 5,538,185

[45] Date of Patent: Jul. 23, 1996

[54] VEHICLE MOUNTED LIQUID SPRAY APPARATUS

[76] Inventors: Benjamin F. Rabitsch; Douglas G. Rabitsch, both of P.O. Box 598, Millen, Ga. 30442

[21] Appl. No.: 172,196

[22] Filed: Dec. 23, 1993

Related U.S. Application Data

[62] Division of Ser. No. 889,979, May 29, 1992, Pat. No. 5,296,747.

[51] Int. Cl.[6] ..... B05B 1/20

[52] U.S. Cl. ..... 239/76; 239/175; 239/176; 239/444; 200/83 J

[58] Field of Search ..... 200/83 J, 83, 81.5; 137/883, 487.5; 239/124, 126, 76, 161–163, 159, 172, 176, 436, 443, 444, 562, 146

[56] References Cited

U.S. PATENT DOCUMENTS

| | | | |
|---|---|---|---|
| 1,938,327 | 12/1933 | Green | 200/83 S |
| 2,069,222 | 2/1937 | Cramer | 200/83 S |
| 2,481,612 | 9/1949 | Nicholson | 200/81.5 |
| 3,117,725 | 1/1964 | Palmer | 239/162 X |
| 3,260,816 | 7/1966 | Schad | 200/83 S |
| 3,679,325 | 7/1972 | Yost | 417/17 |
| 4,052,006 | 10/1977 | Grass | 239/161 X |
| 4,315,602 | 2/1982 | Kubacek et al. | 239/163 |
| 4,530,463 | 7/1985 | Hiniker et al. | 239/71 |
| 5,233,142 | 8/1993 | Dunham | 200/83 J |

*Primary Examiner*—Kevin P. Weldon
*Attorney, Agent, or Firm*—Jacobson, Price, Holman & Stern

[57] ABSTRACT

A reversing switch and more particularly a diaphragm operated electrical polarity reversing switch which has general utility but in the application the reversing switch is disclosed for use in combination with a vehicle mounted spray device including a discharge nozzle which may be used for applying chemicals, liquid fertilizers and other liquids such as when applying such materials alongside of roadways to effectively apply liquid throughout the width of the road right-of-way in which spray nozzles are mounted adjustably on a pivotal arm-type support assembly at the right front of a vehicle and a control arrangement is oriented in the cab of the vehicle to enable the vehicle operator to control the spray apparatus. A diaphragm is communicated with a pressurized supply line with the diaphragm being responsive to pressure in the supply line together with a control valve to direct flow to one of a plurality of different sized nozzles in order to maintain a constant pressure of liquid at each nozzle with any temporary variation in the pressure caused by switching from one nozzle to another being promptly corrected thus providing a constant flow rate and constant width of discharge of liquid from the nozzle.

11 Claims, 5 Drawing Sheets

VEHICLE MOUNTED LIQUID SPRAY APPARATUS

This is a division of U.S. patent application Ser. No. 07/889,979 filed May 29, 1992, now U.S. Pat. No. 5,296,747 issued Mar. 22, 1994.

BACKGROUND OF THE INVENTION

1. Field of the Invention

The present invention generally relates to a reversing switch and more particularly a diaphragm operated electrical polarity reversing switch which has general utility but in the application the reversing switch is disclosed for use in combination with a vehicle mounted spray device including a discharge nozzle which may be used for applying chemicals, liquid fertilizers and other liquids such as when applying such materials alongside of roadways to effectively apply liquid throughout the width of the road right-of-way in which spray nozzles are mounted adjustably on a pivotal arm-type support assembly at the right front of a vehicle and a control arrangement is oriented in the cab of the vehicle to enable the vehicle operator to control the spray apparatus. A diaphragm is communicated with a pressurized supply line with the diaphragm being responsive to pressure in the supply line together with a control valve to direct flow to one of a plurality of different sized nozzles in order to maintain a constant pressure of liquid at each nozzle with any temporary variation in the pressure caused by switching from one nozzle to another being promptly corrected thus providing a constant flow rate and constant width of discharge of liquid from the nozzle.

2. Description of the Prior Art

Various efforts have been made to discharge liquids from nozzles in a manner to maintain a predetermined rate of discharge on a given area when the nozzle is moved over the area at a given speed. The following U.S. Pat. Nos. 2,837,611, 2,996,588, 3,260,816, 4,315,602, 4,525,698, 4,875,235, 4,892,985, and 5,076,497 relate to this field of endeavor.

The above patents disclose various structures relating to spray nozzles and diaphragm operated switches as well as a switch that will reverse polarity of a DC motor to provide selective rotational output from the motor. However, none of the patents disclose a reversing polarity switch utilizing a neutral position and to effectively and quickly retain a constant discharge pressure supplied to spray nozzles having different discharge rates.

All spray nozzles used for applying chemicals, liquid fertilizers and other liquids contain an orifice of a specific size to regulate the flow of liquid through the nozzle. In order to use spray nozzles, it is first necessary to determine the amount of spray per acre or per yard or some other unit of surface measurement. For the purpose of this report, per acre will be used as the unit of surface measurement.

Once the amount of liquid desired per acre at a given speed and pressure has been determined, the nozzle size then can be selected. All spray nozzles currently being manufactured are supplied with charts which give their flow rate in gallons per minute and in gallons per acre at several operating pressures as well as at a variety of operating speeds.

Spray nozzles used on boom sprayers normally have band widths from a few inches up to about five feet. A boom sprayer with a twenty foot boom on either side of the sprayer, for a total boom width of forty feet, can have as few as eight and up to thirty or more spray nozzles attached.

Some special application sprayers have been lengths of up to eight feet.

Boomless spray nozzles, as the name implied, operate without the need for booms. Some manufacturers group together a cluster of straight stream nozzles with a variety of orifice sizes. The smallest nozzle in angled down to spray the area nearest to the sprayer. The next nozzle is angled to spray a few inches further out and so on until all of the nozzles in the cluster are used to spray a given pattern width.

Other boomless nozzles such as that disclosed in U.S. Pat. No. 5,076,497 are designed to spray in a fan-type pattern and require only one nozzle to spray a given distance. If more than one pattern width is required, such as in right-of-way spraying, a separate nozzle will be needed for each pattern width.

Boom-type arrangements, cluster nozzles and nozzles shown in U.S. Pat. No. 5,076,497 require among other things three basic items in order to operate properly. First, all require a pump with a power source to supply the nozzles with a pressurized liquid. These pumps and their power sources vary widely in size and are selected to match the needs of a particular sprayer.

Second, they must have one or more valves, depending on the number of nozzles or clusters, in order to turn the sprayer on and off. Several different types of valves used for this purpose are available. Most of these valves operate either manually or electrically.

Third, all must have some type of device to maintain consistant pressure on the nozzle or nozzles while spraying. The most commonly used device for this purpose is a manually-set bypass-type pressure regulator. This is a spring-loaded device with a threaded screw handle. When the handle is turned clockwise, it tightens the spring which is resting against a valve located in a seat within the regulator. The increase in valve spring pressure requires a corresponding increase in liquid pressure to overcome the spring pressure and open the bypass valve thus increasing the pressure on the nozzle or nozzles.

Likewise, turning the handle counterclockwise will produce less pressure on the nozzle or nozzles. A single regulator of this type will not maintain a constant pressure on two or more nozzles in a system requiring different flow rates.

Two other devices used to control pressure in sprayers are the ball valve and the butterfly valve. When used on mobile spraying equipment, these valves are operated by small twelve volt DC motors which are powered by the battery of the spraying vehicle. The motor is connected to the valve through a speed reducing gear mechanism. This type of valve can require from a few to several seconds to travel from fully open to fully closed. When used as a pressure regulator on spraying vehicles, these valves can be placed in line upstream of the nozzles thus controlling the pressure on the nozzles.

In almost all spraying applications, at one time or another, it becomes necessary to use only a portion of the equipment's total band width. For example, a sprayer with a total band width of forty feet may need to be temporarily reduced to twenty feet or to ten feet for narrow areas such as around field edges in agriculture. In right-of-way spraying, the need to change band widths occurs much more frequently.

In order to accommodate these changing needs with manually set bypass-type regulators, each boomless nozzle, nozzle cluster or boom section must have its own bypass regulator. Each of these bypass regulators, as the name implies, must have a bypass or return line from the regulator to the liquid supply tank. In some cases, synchronizing several of these regulators to maintain a constant pressure in the various modes of the sprayer operation becomes very difficult.

When using electrically operated ball or butterfly valves as pressure regulators, the job of maintaining constant nozzle pressure on all of the nozzles becomes somewhat simpler. Since the motors in ball and butterfly valves operate on DC current, they will operate either clockwise or counterclockwise. They can be instantly reversed by reversing the electrical polarity to the motor with a double-pole double-throw normally-open type manually operated switch.

These valve are usually controlled from a remote control panel conveniently located near the equipment operator. A remote control panel of this type would normally contain a master switch for turning the unit on and off. It would contain a pressure gauge for monitoring pressure and may contain one or more switches for selecting different nozzles or boom sections for the purpose of spraying various band widths.

In almost all spraying operations, it is usually desirable for the spraying vehicle to maintain a constant speed as well as to maintain a constant liquid pressure on all of the nozzles regardless of flow rates or band widths. In order to maintain constant pressure on the system when using motorized ball or butterfly valves, the control panel must contain an electrical polarity reversing switch.

For example, assume that a nozzle or boom section spraying a ten foot band width will apply the desired amount of liquid per acre at ten miles per hour operating at forty pounds of pressure. When the sprayer is turned on, the operator must observe the pressure gauge and either open or close the motorized valve manually with the polarity reversing switch as necessary to obtain the desired forty pounds of pressure on the nozzle or boom section in use. Each time the operator changes band widths by switching from one nozzle to another, the pressure must be readjusted also using the motorized valve. In right-of-way spraying, this switching and readjusting can occur as often as several time in a matter of a few minutes.

Switching from one nozzle to another by the operator can usually be accomplished fairly quickly. However, resetting the nozzle pressure each time after switching band widths can require several seconds. Since the driver must direct his attention to the pressure gauge while manipulating the pressure resetting switch, and away from driving the vehicle, a hazardous situation could occur.

This scenario prompted the beginning of our efforts to develop a simpler and safer method of maintaining constant pressure automatically on sprayers equipped with multiple band width requirements. After some time, we were able to develop such a device which we refer to as a smart switch. The generic description for this switch is a pressure-sensitive electrical polarity reversing switch with neutral capability.

When using this switch to maintain constant pressure on multiple band width spraying equipment or other liquid handling equipment requiring constant pressure on multiple flow rates, the switch must be used in conjunction with an electric motorized ball or butterfly valve. What this switch does in essence is to supply the motorized valve with current in the proper polarity to open or to close the valve in the proper amount to allow for the proper flow rate through the valve sufficient to produce the desired preset nozzle pressure.

Each time a different size nozzle, boom section or cluster of nozzles is selected during the spraying operation, the smart switch senses a pressure change in the system caused by the change in flow rate. When the smart switch senses this change, it activates the motorized valve which makes the necessary flow correction to maintain the proper pressure in about two seconds.

SUMMARY OF THE INVENTION

An object of the present invention is to provide a pressure operated electrical polarity reversing switch which is diaphragm operated especially adapted for maintaining constant pressure on a sprayer equipped with multiple nozzles to satisfy multiple band width requirements or other liquid handling equipment requiring constant pressure on multiple flow rates in which the switch is utilized in combination with an electrically motorized ball or butterfly valve for supplying the motorized valve with electrical current in the proper polarity to open or close the valve in an appropriate amount to permit proper flow rate through the valve sufficient to produce the desired preset nozzle pressure in a very short period of time and in an automatic manner.

A further object of the invention is to provide an electrical polarity reversing switch as set forth in the preceding object in which a pressure responsive movable member is connected to a diaphragm that moves the movable member in response to change in pressure conditions in a pressure supply line to a plurality of liquid discharge nozzles having different flow rates to maintain the pressure to the nozzles at a substantially constant rate when switching from a nozzle having one flow rate to another nozzle having another flow rate with the movable member completing circuits from an electrical power source to a motorized valve in a manner to reverse polarity to the motor which drives the motorized valve for opening or closing the valve depending upon the conditions sensed by the diaphragm with the structure including a neutral area which stabilizes the motorized valve when the pressure is at a predetermined set pressure thus returning the system to a preset condition when the pressure deviates either above or below the preset pressure when selective nozzles are actuated.

A further object of the invention is to provide an electrical polarity reversing switch in accordance with the preceding objects incorporated an embodiment in which the electrical circuit involves primary contacts and spaced secondary contacts interconnected by crossover strips with a transfer block with spring biased pins mounted on the movable member to complete an electrical circuit between the primary contacts and the spaced secondary contacts depending upon the position of the movable member connected with the diaphragm with the crossover strips interconnecting the secondary contacts providing for reverse polarity electrical energy being supplied to a motorized valve depending upon the position of the transfer block with the space between the secondary contacts being insulated from the secondary contacts and forming a neutral point which will interrupt the electrical circuit to the motorized valve when the transfer block, movable member and diaphragm sense a preset desired pressure in a pressure supply line.

Still another object of the invention is to provide an electrical polarity reversing switch as set forth previously in which a primary contact and pair of spaced secondary contacts are provided as indicated previously with another embodiment of the invention including a spring biased contact actuating arm being engaged by an actuating member on the movable member which moves the arm to actuate the primary contact for engagement with selected secondary contacts in response to sensing pressure variation above and below a desired pressure with an air gap being provided between the contacts to provide a neutral position to interrupt the electrical circuit to the motorized valve when the pressure in the pressure supply line has reached a desired pressure.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
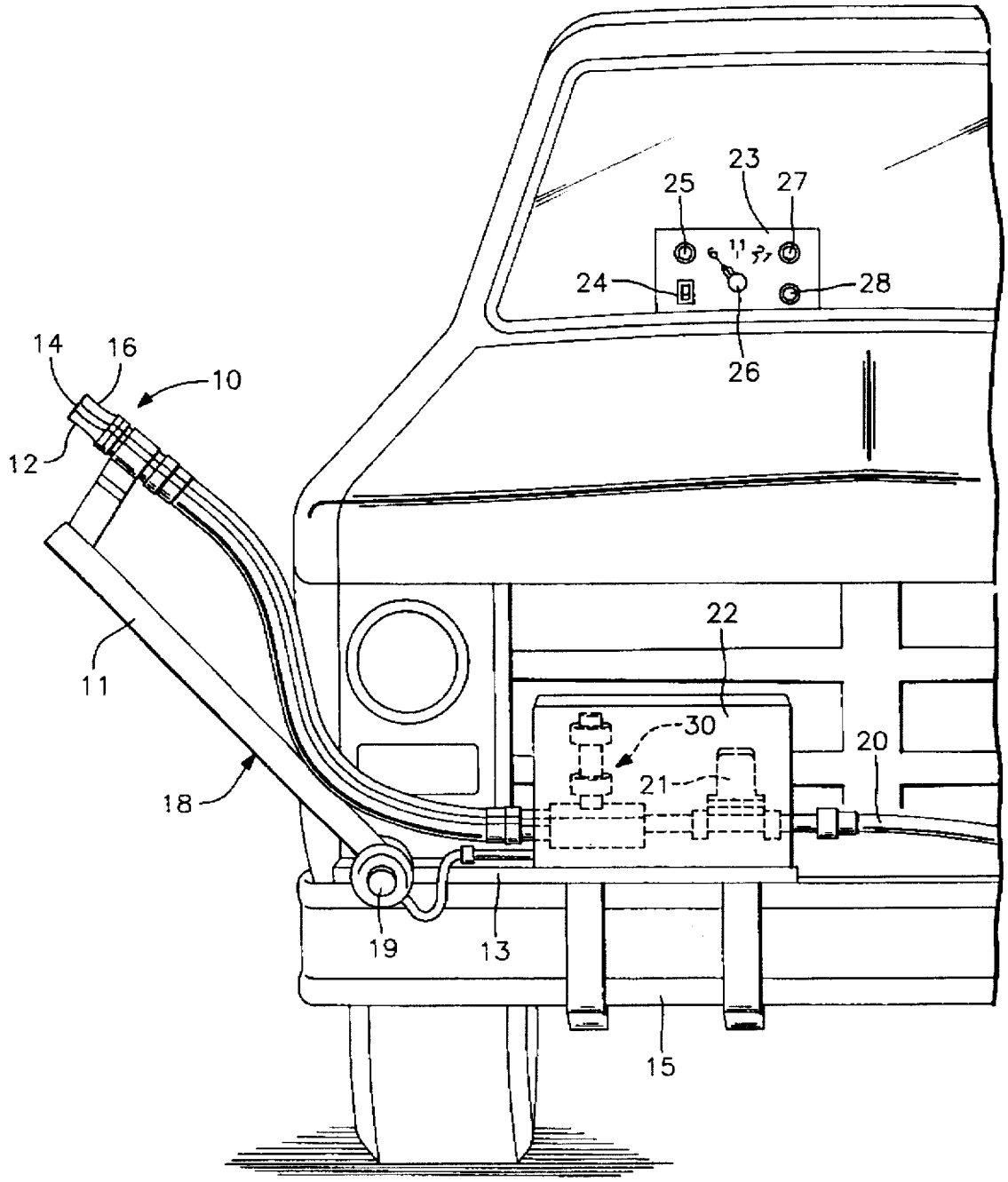
FIG. 1 is a schematic view illustrating a spraying apparatus for spraying right-of-ways and the like associated with a vehicle such as a pick-up truck or the like illustrating the association of the multiple nozzle arrangement, a supporting structure therefore and the orientation of a pressure supply line and control arrangement including the electrical polarity reversing switch with the dashboard mounted control facing the windshield instead of the operator of the truck for convenience in describing the structure.

FIG. 1 illustrates a nozzle assembly 10 including three separate discharge nozzles and hoses 12, 14 and 16 having different flow rates but constructed to operate on the same pressure to provide a known rate of discharge. The nozzles are supported from a pivotal support structure 18 in the form of a pivotal arm 11 supported by a suitable bracket 13 from a vehicle bumper 15 with the angularity of the arm 11 being adjustable to enable different right-of-way configurations to be effectively sprayed. This can be accomplished by a pin which locks the arms in different angular positions or a remotely controlled electric motor and worm gear drive assembly 19 associated with the pivotal connection between the arm 11 and bracket 13. A pressure pump, motor such as a small gasoline engine and supply tank (not shown) provides a pressurized supply through a pressure line 20 operatively connected to the nozzles through a motorized reversing butterfly valve 21 is associated with the pressure supply line 20 to provide a predetermined pressure supply to the nozzles. In order to automatically maintain a desired pressure to the nozzles when changing from a nozzle having one discharge flow rate to a nozzle having another discharge flow rate, a pressure operated electrical polarity reversing switch, generally designated by reference numeral 30 of the present invention is provided and includes a fitting 32 connected to the fluid pressure line 20 or a manifold downstream of motorized valve 21 which has 3 solenoid valves controlling flow to the nozzles. As illustrated, the fluid pressure line 20 is connected to a lower diaphragm housing 34 and communicated with a lower diaphragm cavity 36. A diaphragm 38 is positioned between the lower diaphragm housing 34 and an upper diaphragm housing 40 which includes an upper diaphragm cavity 42. The diaphragm is connected to an elongated shaft or movable member 44 which is connected to the diaphragm 38 and retained thereon by a retaining nut 46. The upper and lower diaphragm housings are interconnected by bolts 48 and nuts 50. The shaft 44 is guided in a tubular shaft housing 52 that is connected to the upper diaphragm housing 40 and a compression coil spring 54 encircles the shaft 44 and has a lower end abutting the diaphragm 38 and the upper end abutting a shoulder 56 in the housing 52.

Figure 3A:
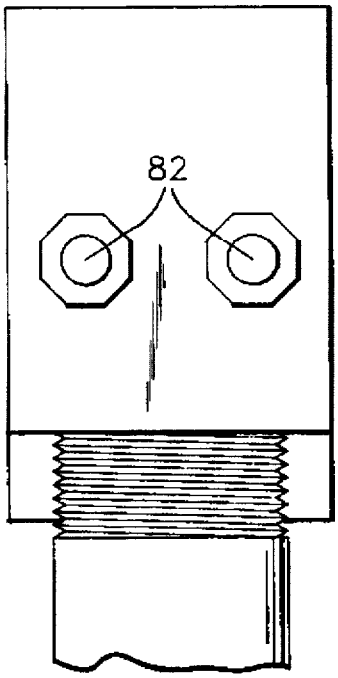
FIGS. 3A and 3B disclose the outside and inside configuration of the primary contact plates.
Figure 3B:
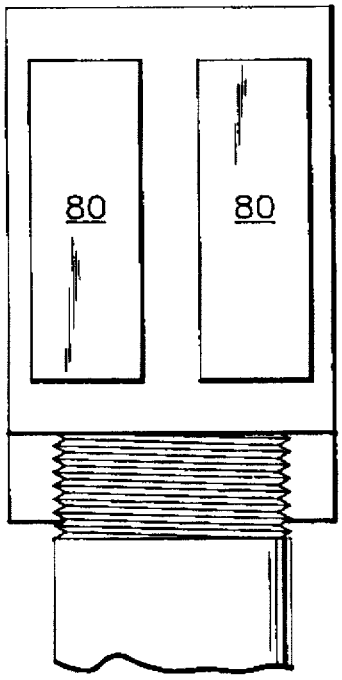
Figure 4A:
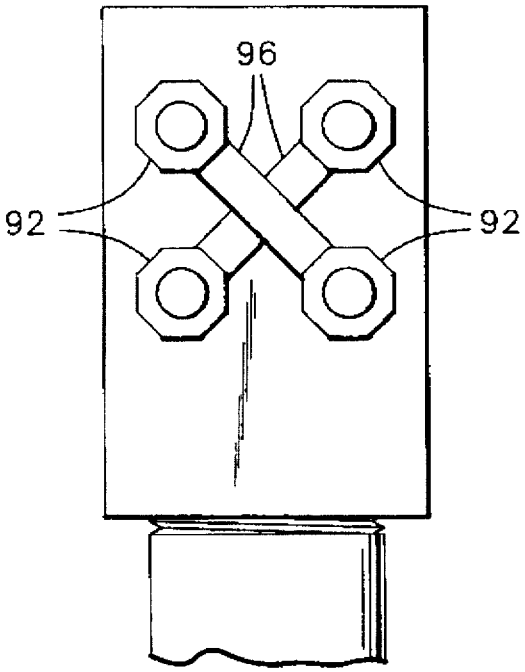
FIGS. 4A and 4B disclose the outside and inside configuration of the upper and lower contact terminals and strips.
Figure 4B:
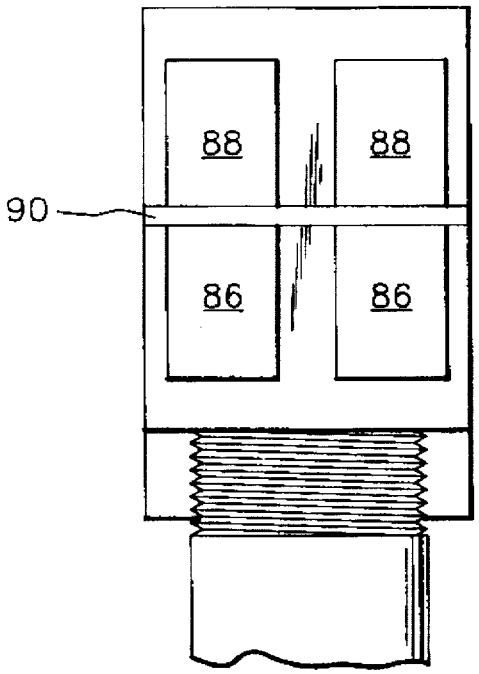

The upper end of the housing 52 is connected to a transfer block housing 58 with the shaft 44 extending upwardly through the hollow interior 60 of the housing 58 and terminating in an externally threaded upper end portion 62 receiving a transfer block adjusting nut 64 thereon. The nut 64 engages a transfer block 66 which is movable in the hollow interior 60 of the housing 58 with a transfer block spring 68 engaging the bottom end of the transfer block 66 and having its other end engaging a shoulder 70 in the housing 52. The center of the transfer block 66 includes a passageway 72 for the connecting shaft 44 and a transverse passageway 74 for receiving a pair of transfer pins 76 which project outwardly from the transfer block and biased outwardly by a transfer pin spring 78. There are two sets of pins which are spaced on opposite sides of the passageway 72 and the transfer block 66 and the pins 76 engage a pair of primary contact plates 80 connected with primary terminals 82 retained in place by terminal nuts 84. The other ends of the pins 76 contact a pair of lower secondary contact plates 86 or a pair of upper secondary contact plates 88 which are spaced from each other by an insulating strip 90. The contact plates 86 are connected to lower secondary terminals 92 and the upper secondary contact plates 88 are connected to upper secondary terminals 94. The terminals 92 and 94 are interconnected by reversing polarity strips 96 retained in place by terminal nuts 98. The details of the these components are disclosed in FIGS. 2–4.

Figure 2:
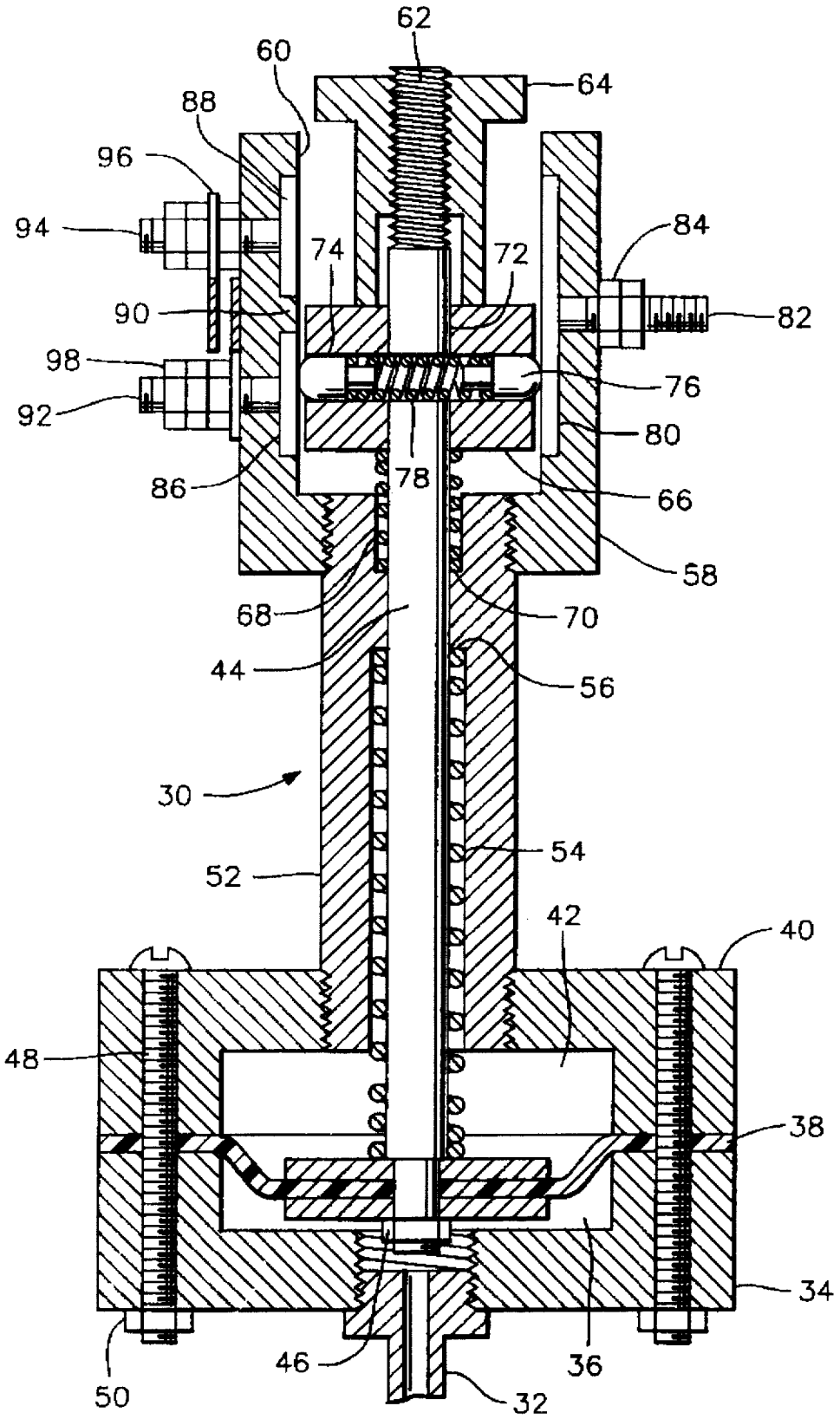
FIG. 2 is a vertical sectional view of one form of the electrical reversing polarity switch of the present invention.
Figure 2A:
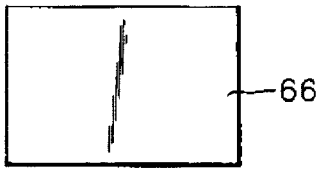
FIGS. 2A–2G illustrate the specific structural details of the transfer block.
Figure 2B:
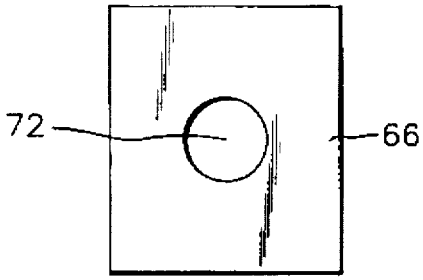
Figure 2C:
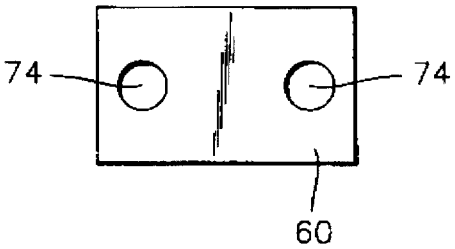
Figure 2G:
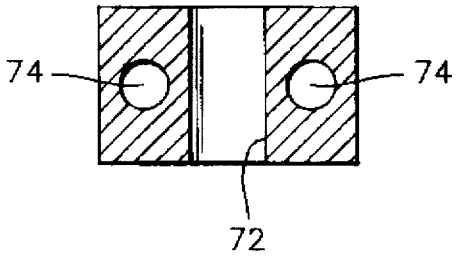
Figure 2D:
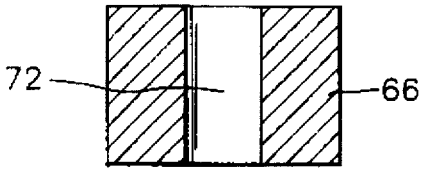
Figure 2E:
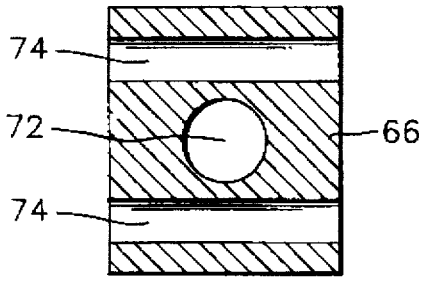
Figure 2F:
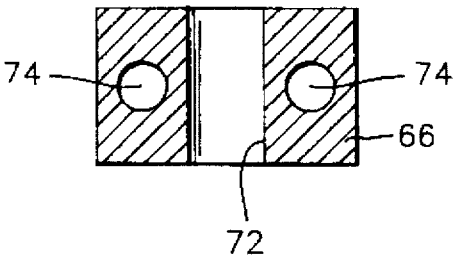

The assembly shown in FIG. 2 illustrates the switch 30 in a no pressure or at rest position. In order for the switch to operate, it must be connected to a pressure line or pipe leading from the pressure source to be controlled and connected to the pressure line fitting 32. The motorized valve must be connected in line upstream of the point where the switch 30 is connected to the flow line with a branch pressure line connected to the fitting 32. The nozzles 12, 14 and 16 to be controlled must be downstream from the fitting 32. In operation, when sufficient pressure and as the lower diaphragm cavity 36, it causes the diaphragm to rise a predetermined amount equal to the desired operating pressure range of the switch. For example, if the desired pressure range of the switch 30 is from 30 to 50 lbs. per square inch, 30 psi will be required to move the diaphragm 38 from its lower position of rest while 50 psi will raise the diaphragm to its upper limit of travel. As the diaphragm moves, the connecting shaft 44 attached thereto also moves upwardly.

The transfer block 66 is loosely fitted to the shaft 44 and is held in a specific location by the transfer block spring 68 and the transfer block adjusting nut 64. The transfer block 66 moves upwardly and downwardly with the shaft 44.

When the diaphragm 38 is located in the upper half of its total travel range, an electrical current is connected to the primary terminals 82, the electrical current passes to the primary contact plates 80 and through the transfer pins 76, spring 78 to the lower secondary terminal plates 86. In this configuration, electrical polarity is maintained from the source to the electric motor driving the motorized valve. The electrical conductors referred to are made of copper or other conductive material and are insulated with a dielectric material in a conventional and well known manner without creating a short circuit. The transfer block housing and the transfer block and other housing components would be made of nylon or other similar dielectric material and it is pointed out that the switch will work as well with AC or DC motors that are designed to be reversible.

If the diaphragm 38 is located in the upper half of its travel range, the transfer block 66 will also be located in the upper half of the transfer block housing 58. In this position, electric current flows from the primary terminals 82 to the upper secondary contact plates 88 down through the polarity reversing strips 96 and out to the electric motorized valve through the lower secondary terminals 92 to which the electric motor for the motorized valve is connected thus reversing the electrical polarity of the current to the electric motorized valve causing it to operate in the opposite direction. The electrical insulating strip 90 is located halfway between the upper and lower travel range of the transfer block and this strip separates the upper secondary contact plates 88 from the lower secondary contact plates 86 thus completing insulation between the upper and lower secondary contact plates. When sufficient pressure is applied to the lower diaphragm cavity 36, the diaphragm 38 begins to rise against the pressure of the diaphragm spring 54 causing the connecting shaft 44, transfer block 66 and transfer pins 76 to rise also. If electric current is available through the primary terminals 82, through the transfer pins 76, through the lower secondary contact plates 86, out to the motorized valve, through the lower secondary terminals 92, the motorized valve will continue to open until sufficient pressure is reached in the lower diaphragm cavity 36 to raise the transfer pins 76 to the to the insulating strip 90, which prevents any further current flow to the motorized valve.

The valve will then cease to open any further, and the diaphragm 38 will stabilize and cease to move the transfer pins 76 any further. Thus, the system will be stabilized at a specific pressure. The switch will remain in this stable configuration so long as the flow rate remains constant through the system being controlled by the switch.

If the flow rate through the system increases as a result of opening a valve to a larger nozzle, the system pressure will decrease causing the diaphragm 38 and transfer pins 76 to move downward. This would again make electrical contact to the motorized valve causing it to further open in a sufficient amount to compensate for the increased flow demand of the larger nozzle. When the increased flow rate is reached, the pressure will build in the system and in the lower diaphragm cavity 36 causing the diaphragm 38 to raise the transfer pins 76 back to the insulating strip 90, thereby disconnecting the electrical current to the motorized valve.

If the flow rate in the system decreases as the result of opening a valve to a smaller nozzle, the system pressure will increase causing the diaphragm 38 to raise the transfer pins 76, thus energizing the upper secondary contact plates 88 allowing current to flow through the polarity reversing strips 96 which are attached to the upper secondary terminals 94 and the lower secondary terminals 92 in reverse order, thus reversing the polarity of the current flowing from the lower secondary terminals 92 to the motorized valve which causes the valve to operate in the opposite direction, thereby closing the motorized valve.

As the valve closes, and the flow rate through the system begins to decrease, the system pressure will drop lowering the pressure in the lower diaphragm cavity 36 allowing the diaphragm 38 and transfer pins 76 to move downward until the transfer pins 76 reach the insulating strip 90. When this occurs, the current to the motorized valve will be disconnected, and the preset pressure on the system will again be stabilized.

The tension of the diaphragm spring 54 determines the pressure operating range of the switch. As pointed out earlier, the diaphragm spring 54 may exert sufficient pressure on the diaphragm 38 to prevent it from moving until 30 psi is exerted on the diaphragm 38. It may require 50 psi to force the diaphragm 38 to the upper limit of its travel. This would give the switch an operating range from 30 to 50 psi.

Since the transfer block 66 containing the transfer pins 76 can be adjusted up or down on the connecting shaft 44 by turning the transfer block adjusting nut 64 clockwise or counterclockwise, the switch can be preset to operate at any desired pressure within the operating range of 30 to 50 psi. Almost all agricultural and commercial spraying equipment operates within this pressure range.

By installing different diaphragm springs 54 with the proper tension, this switch can be made to operate over a wide variety of pressure ranges with unlimited application possibilities other than those mentioned in this report.

Figure 6:
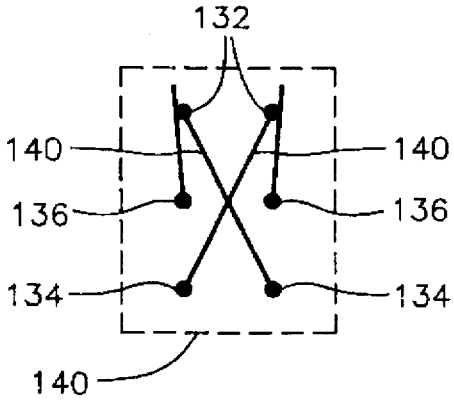
FIG. 6 is a schematic illustration of the double-pole double-throw normally closed switch with polarity reversing strips and neutral capabilities employed in the embodiment of the invention illustrated in FIG. 5.
Figure 5:
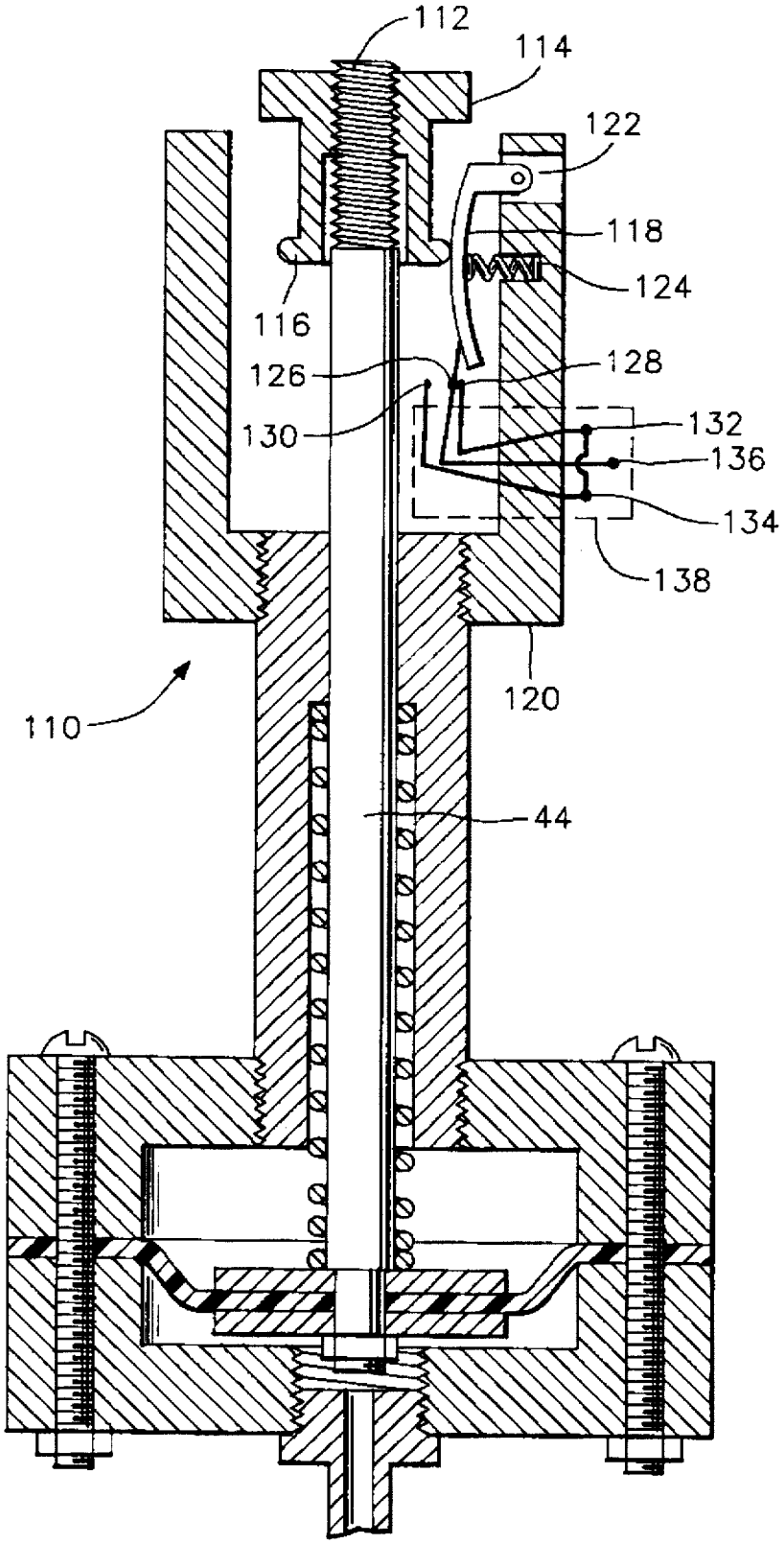
FIG. 5 is a vertical sectional view of another embodiment of the electrical reversing polarity switch.

FIGS. 5 and 6 illustrate a second embodiment of the invention generally designated by reference numeral 110 in which the diaphragm shaft and shaft housing remain the same and are identified by the same reference numerals. In this construction, the upper end of the shaft is threaded at 112 to adjustably receive a switch actuating arm adjustment nut 114 which has a lower flange 116 which engages a switch actuating arm 118 pivoted to a switch housing 120 by a pivot pin or hand structure 122. The arm 118 is biased inwardly toward the flange 126 by a switch actuating arm spring 124 with the arm 118 being arcuately curved as illustrated in FIG. 5. The switch actuating arm 118 is associated with the end of a primary contactor 126 which extends upwardly beyond upper secondary contactors 128 and lower secondary contactors 130 which are connected to upper secondary terminals 132 and lower secondary terminals 134 with the primary contactor being connected to primary terminals 136. The switch structure generally designated by reference numeral 138 is a double-pole double-throw normally closed switch with polarity reversing strips 140 with the air gap between the contactors providing neutral capabilities with this arrangement being illustrated in FIG. 6.

The switch activator arm adjusting nut 114 is threaded and attached to the connecting shaft 44 which is threaded also. A beveled edge ring 116 surrounds the lower end of the adjusting nut 114. The switch activator arm spring 124 holds the switch activator arm 118 in constant contact with the beveled edge of the adjusting nut ring 116. As the connecting shaft 44 and adjusting nut 114 move up and down, the switch activator arm 118 moves the primary contactors 126 back and forth between the upper secondary contactors 128 and lower secondary contactors 130.

When the diaphragm 38 is located in the lower half of its total travel range, and electric current is connected to the primary terminals 136, it passes to the primary contactors 126 through the upper secondary contactors 128, to the upper secondary terminals 132, through the polarity reversing strips 140, and out from the lower secondary terminals 134 to the motorized valve. In this configuration, electrical polarity is reversed from the source to the electric motor.

When the diaphragm 38 is located in the upper half of its total travel range, the adjusting nut 114 will also be located in the upper half of the total travel range. With the adjusting nut 114 in this position, and when electric current is applied to the primary terminals 136, it passes to the primary contactors 126, through the lower secondary contactors 130 and out to the electric motorized valve through the lower secondary terminals 134 thus maintaining the electrical polarity of the current to the electric motorized valve, causing it to operate in the opposite direction. The double-pole double-throw switch 138 is designed in such a manner that air gaps act as insulation between the contactors as the contactors 126, 128 and 130 are disconnected by the switch activator 118. This gap separates the upper secondary contactors 128 from the lower secondary contactors 130 and the primary contactors 126 when the switch activator arm 118 moves the primary contactors 126 to the center or neutral position.

When sufficient pressure is applied to the lower diaphragm cavity 36, the diaphragm 38 begins to rise against the pressure of the diaphragm spring 54 causing the connecting shaft 44 and the switch activator arm adjusting nut 114 to rise. If electric current is available through the primary terminals 136, through the primary contactors 126, through the upper secondary terminals 132, out to the motorized valve, through the lower secondary terminals 134, the motorized valve will continue to open until sufficient pressure is reached in the lower diaphragm cavity 36 to raise the adjusting nut 114 until the switch activator arm 118 moves the primary contactors 126 to the center or neutral position between contactors 128 and 130. This prevents any further current flow to the motorized valve.

The valve will then cease to open any further, and the diaphragm 38 will stabilize and cease to move the adjusting nut 114 any further. Thus, the system will be stabilized at a specific pressure. The switch will remain in this stable configuration so long as the flow rate remains constant through the system being controlled by the switch.

If the flow rate through the system increases as the result of opening a valve to a larger nozzle, the system pressure will decrease causing the diaphragm 38 and adjusting nut 114 to move downward. This would again make electrical contact to the motorized valve causing it to further open in a sufficient amount to compensate for the increased flow demand of the larger nozzle. When the increased flow rate is reached, the pressure will build in the system and in the lower diaphragm cavity 36 causing the diaphragm to raise the adjusting nut 114 until the activator arm 118 disconnects the primary contactors 126, thereby disconnecting the electrical current to the motorized valve.

If the flow rate in the system decreases as the result of opening a valve to a smaller nozzle, the system pressure will increase causing the diaphragm 38 to raise the adjusting nut 114, thus energizing the lower secondary contactors 130, allowing current to flow through the lower secondary terminals 134 in reverse order, thus reversing the polarity of the current flowing from the lower secondary terminals 134 to the motorized valve which causes the valve to operate in the opposite direction, thereby closing the motorized valve.

As the valve closes, and the flow rate through the system begins to decrease, the system pressure will drop lowering the pressure in the lower diaphragm cavity 36 allowing the diaphragm 38 and adjusting nut 114 to move downward until the switch activator arm 118 disconnects the primary contactors 126 from the lower secondary contactors 130. When this occurs, the current to the motorized valve will be disconnected, and the preset pressure on the system will again be stabilized.

The tension of the diaphragm spring 54 determines the pressure operating range of the switch. As pointed out earlier, the diaphragm spring 54 may exert sufficient pressure on the diaphragm 38 to prevent it from moving until 30 psi is exerted on the diaphragm 38. It may require 50 psi to force the diaphragm 38 to the upper limit of its travel. This would give the switch an operating range from 30 to 50 psi.

Since the switch activator arm adjusting nut 114 can be adjusted up or down on the connecting shaft 44 by turning the adjusting nut 114 clockwise or counterclockwise, the switch can be preset to operate at any desired pressure within the operating range of 30 to 50 psi.

As shown in FIG. 1, the valve 21, switch 30 and manifold and solenoid valve for each nozzle are mounted in a housing 22 supported on the bumper 15 by bracket 13. A control box 23 can be positioned in the vehicle for observation and access by the operator to control operation of the nozzles. The control box 23 includes an on-off switch 24, an indicator light 25, a rotary selector switch 26 to operate the solenoid valves to select which nozzles is to be supplied with pressurized liquid. Adjacent the selector switch 26, there is a high pressure indicator light 27 and a low pressure indicator light 28.

When the switch 26 is rotated to actuate a nozzle with a higher flow rate, the pressure will drop and the lower pressure light 28 will be energized along with the butterfly valve 21 to increase flow to the nozzle. As the pressure to the selected nozzles increases to optimum operating pressure, the switch 30 moves to neutral thus deenergizing valve 21 and light 28.

When the switch 26 is rotated to actuate a nozzle with a lower flow rate, the pressure will increase and the switch will energize the high pressure light 27 and valve 31 in a reverse direction by reversing polarity to the valve 21 to decrease flow to the selected nozzle. As the pressure to the selected nozzle decreases, the switch 30 moves to neutral position and deenergizes the valve 21 and light 27.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A liquid spraying apparatus adapted to be mounted on a vehicle for applying liquid to a traversed surface at different flow rates comprising a plurality of independently actuated valved nozzles with each nozzle having a different flow rate when supplied liquid at the same predetermined pressure, means supplying liquid to said nozzles at said predetermined pressure, said means including a reversible motorized valve controlling flow to the nozzles for varying the flow rate to the nozzles thereby maintaining said predetermined pressure and means controlling said motorized valve to move the motorized valve toward open and closed positions for varying the flow rate of liquid to said nozzles in response to pressure variances which occur when nozzles having different flow rates are actuated to maintain said predetermined pressure supplied to the nozzles by opening and closing the motorized valve as the different nozzles are actuated, said means controlling movement of the motorized valve including a pressure responsive switch communicated with the supply of liquid between the motorized valve and valved nozzles to sense the pressure, said switch including means to electrically energize the motorized valve in a manner to move the valve toward closed position when the pressure sensed is higher than said predetermined pressure and to move the motorized valve towards open position when the pressure sensed is less than said predetermined pressure, said switch including a diaphragm communicated with the liquid supply and an actuating member connected to the diaphragm for controlling said means to electrically energize the motorized valve by completion and interruption of electrical circuits to the motorized valve and by reversing the polarity of electrical energy supplied to the motorized valve to operate the valve for movement toward open and closed positions, said means to electrically energize said motorized valve including a pair of spaced secondary contact means adapted to be electrically connected with the motorized valve, primary contact means adapted to be electrically connected to an electrical power source, said actuating member including movable contact means for selectively completing electrical circuits from said primary contact means to said spaced secondary contact means to move said valve in opposite directions by reversing polarity of electrical energy supplied to the motorized valve, said secondary and primary contact means and said movable contact means being oriented to form a neutral area which interrupts the electrical circuits when the diaphragm senses the predetermined pressure to stabilize said motorized valve when the predetermined pressure is sensed to maintain the flow rate through each selectively actuated valved nozzle.

2. The apparatus as defined in claim 4 including a control means positioned in the vehicle for observation and access by the operator to selectively actuate said nozzles, said control means including a selector switch for operating a solenoid controlled valve associated with a selected nozzle to be supplied with pressurized liquid at the predetermined pressure.

3. The apparatus as defined in claim 1 wherein said neutral area includes a non-conductive area insulated from said movable contact means to interrupt flow of electrical energy from said primary contact means to said secondary contacts means.

4. A liquid spraying apparatus adapted to be mounted on a vehicle for applying liquid to a traversed surface at different flow rates comprising a plurality of independently actuated valve nozzles with each nozzle having a different flow rate when supplied liquid at the same predetermined pressure, means supplying liquid to said nozzles at said predetermined pressure, said means including a reversible motorized valve controlling flow to the nozzles for varying the flow rate to the nozzles thereby maintaining said predetermined pressure and means controlling said motorized valve to move the motorized valve toward open and closed positions for varying the flow rate of liquid to said nozzles in response to pressure variances which occur when nozzles having different flow rates are actuated to maintain said predetermined pressure supplied to the nozzles by opening and closing the motorized valve as the different nozzles are actuated, said means controlling said reversible motorized valve including a pressure sensing movable member, an electrical circuit including primary contact means connected with an electric power source, spaced secondary contact means connected to said motorized valve, said motorized valve including electrically driven means having an output driven in opposite directions depending upon the polarity of electrical power supplied to said electrically driven means, said pressure sensing movable member completing an electric circuit between said primary contact means and one of said spaced secondary contact means to drive said electrically driven means in a first direction in response to a pressure below said predetermined pressure and completing a circuit to the other of said spaced secondary contact means to drive said electrically driven means in a second direction in response to a pressure above said predetermined pressure, said spaced secondary contact means including a neutral area therebetween to interrupt the electrical circuit to said secondary contact means when the pressure sensing movable member is moving between said secondary contact means to stabilize said electrically driven means and valve when said pressure sensing movable member is moved to a predetermined position in relation to the neutral area in response to the pressure being sensed.

5. The apparatus as defined in claim 4 wherein said nozzles are each provided with an independently actuated solenoid valve to selectively actuate the nozzles, a selector switch for actuating the solenoid valves for selectively actuating the nozzles.

6. The apparatus as defined in claim 5 wherein said selector switch is located in a position on the vehicle adjacent a line of vision of a vehicle operator when observing the path of movement of the vehicle and in a readily accessible position to a vehicle operator for actuation by an operator of the vehicle on which the spraying apparatus is mounted to enable the operator of the vehicle to also control operation of the nozzles.

7. The apparatus as defined in claim 5 together with means adjustably supporting said nozzles from the vehicle for movement about a longitudinal axis generally paralleling the path of movement of the spraying apparatus and vehicle.

8. The liquid spraying apparatus as defined in claim 4 wherein said pressure sensing movable member is connected to a spring biased diaphragm, said diaphragm having a cavity communicating with a liquid pressure line and movable in response to variation in pressure in the liquid pressure line, said movable member including means movable with the diaphragm to close a circuit to increase pressure when the diaphragm senses a low pressure and decrease pressure when the diaphragm senses a high pressure, said neutral area including an insulating space to interrupt the completed electrical circuit when the diaphragm senses said predetermined pressure thus automatically maintaining said predetermined pressure when the pressure in a liquid pressure line deviates above or below said predetermined pressure.

9. The liquid spraying apparatus as defined in claim 8 wherein said movable member includes a transfer block adjustably mounted on one end thereof and including electrical transfer means selectively electrically connecting the primary contact means with the spaced secondary contact means, said neutral area interrupting the electrical connection between the primary contact means and the secondary contact means.

10. The liquid spraying apparatus as defined in claim 8 wherein said movable member includes an adjustable member on one end thereof remote from the diaphragm, a switch actuating arm spring biased into engagement with the adjustable means whereby movement of the movable member and adjusting means will move the arm to connect the primary contact means selectively with the spaced secondary contact means, said insulating space including an air gap disposed to interrupt an electrical circuit between the primary contact means and the spaced secondary contact means when said predetermined pressure is sensed.

11. A liquid spraying apparatus adapted to be mounted on a vehicle for applying liquid to a surface traversed in different width bands comprising a plurality of nozzles with each nozzle having a different flow rate when supplied liquid at a predetermined pressure, means supplying liquid to said nozzles at said predetermined pressure, a reversible motorized valve controlling flow to the nozzles for varying the flow rate to the nozzles thereby maintaining said predetermined pressure and means controlling said motorized valve to move the motorized valve toward open and closed positions for varying the flow rate in response to pressure variances which occur when nozzles having different flow rates are actuated to maintain the predetermined pressure supplied to the nozzles by opening and closing the motorized valve as the different nozzles are actuated, said means controlling movement of the motorized valve including a pressure responsive switch communicated with the supply of liquid between the motorized valve and nozzles to sense the pressure, said switch including means to energize the motorized valve to move it toward a closed position when the pressure sensed is higher than the predetermined pressure and means to energize the motorized valve to move it toward an open position when the pressure sensed is less than the predetermined pressure, said means to energize the motorized valve including primary contact means connected with a power source, secondary contact means spaced from said primary contact means, said secondary contact means being electrically connected to said reversible motorized valve and including a pair of spaced secondary contacts to drive said valve in reversible directions when power is supplied to respective spaced secondary contacts, and a movable conductive member movable in response to pressure in the supply of liquid between the nozzles and motorized valve to selectively electrically connect the primary contact means with one of said spaced secondary contacts in response to pressures above and below said predetermined pressure, the space between the spaced secondary contacts forming a neutral area therebetween to interrupt all electrical circuits to said motorized valve to stabilize the motorized valve when liquid supplied to said nozzles is at said predetermined pressure.

* * * * *